US010115536B2

(12) United States Patent
Larcher et al.

(10) Patent No.: US 10,115,536 B2
(45) Date of Patent: Oct. 30, 2018

(54) ELECTROMAGNETIC ACTUATOR AND ELECTRICAL CONTACTOR COMPRISING SUCH AN ACTUATOR

(71) Applicant: SCHNEIDER ELECTRIC INDUSTRIES SAS, Rueil-Malmaison (FR)

(72) Inventors: Patrick Larcher, Echirolles (FR); Vincent Geffroy, Faramans (FR)

(73) Assignee: SCHNEIDER ELECTRIC INDUSTRIES SAS, Rueil-Malmaison (FR)

( * ) Notice: Subject to any disclaimer, the term of this patent is extended or adjusted under 35 U.S.C. 154(b) by 0 days.

(21) Appl. No.: 15/505,433

(22) PCT Filed: Sep. 23, 2015

(86) PCT No.: PCT/EP2015/071821
§ 371 (c)(1),
(2) Date: Feb. 21, 2017

(87) PCT Pub. No.: WO2016/046249
PCT Pub. Date: Mar. 31, 2016

(65) Prior Publication Data

US 2017/0271095 A1 Sep. 21, 2017

(30) Foreign Application Priority Data

Sep. 24, 2014 (FR) ..... 14 59007

(51) Int. Cl.
*H01H 3/00* (2006.01)
*H01H 3/28* (2006.01)
(Continued)

(52) U.S. Cl.
CPC ..... *H01H 3/28* (2013.01); *H01H 51/2209* (2013.01); *H01F 7/1646* (2013.01)

(58) Field of Classification Search
CPC ..... H01H 3/28; H01H 51/2209; H01H 1/36; H01F 71/1646
(Continued)

(56) References Cited

U.S. PATENT DOCUMENTS 269,453 A * 12/1882 Parker ..... H05B 31/0081 314/109
2,528,777 A * 11/1950 Persons ..... H01H 50/323 335/259
(Continued)

FOREIGN PATENT DOCUMENTS

| | | |
|---|---|---|
| EP | 2 549 498 A1 | 1/2013 |
| FR | 2 847 379 A1 | 5/2004 |
| FR | 2 979 745 A1 | 3/2013 |

OTHER PUBLICATIONS

International Search Report dated Dec. 11, 2015 in PCT/EP2015/071821 Filed Sep. 23, 2015.

*Primary Examiner* — Shawki S Ismail
*Assistant Examiner* — Lisa Homza
(74) *Attorney, Agent, or Firm* — Oblon, McClelland, Maier & Neustadt, L.L.P.

(57) ABSTRACT

An electromagnetic actuator of an electrical contact includes: a stationary portion including at least one coil generating a magnetic field centered on a longitudinal axis; at least one core concentrating magnetic flux, installed within the coil, and including a plate spreading the magnetic flux and defining an active surface perpendicular to the longitudinal axis, and at least one element returning magnetic flux; an armature translationally movable along the longitudinal axis and relative to the stationary portion between first and second positions, by a force induced by the magnetic field; and at least one device returning the armature elastically to a predetermined position of the first position or second position. The spreading plate includes at
(Continued)

least one rib closing magnetic field lines between the spreading plate and the armature, protruding relative to the active surface on the armature side and housed on one edge of the spreading plate.

13 Claims, 6 Drawing Sheets

(51) Int. Cl.
*H01H 51/22* (2006.01)
*H01F 7/16* (2006.01)

(58) Field of Classification Search
USPC ..... 335/185
See application file for complete search history.

(56) References Cited

U.S. PATENT DOCUMENTS 2,944,195 A * 7/1960 Mobarry ..... H01H 50/22 335/245
3,821,671 A * 6/1974 Devault ..... H01H 50/045 335/132
4,179,676 A * 12/1979 Selas ..... H01H 43/28 200/34
4,617,546 A * 10/1986 Kellogg ..... H01H 51/2209 335/170
8,237,524 B2 * 8/2012 Niimi ..... F02N 15/067 335/126
8,269,588 B2 * 9/2012 Sohn ..... H01F 7/1615 335/220
8,289,110 B2 * 10/2012 Niimi ..... H01H 51/065 335/126
8,305,166 B2 * 11/2012 Kojima ..... H01H 50/043 335/78
8,344,832 B2 * 1/2013 Lee ..... H01H 51/065 335/126
8,993,903 B2 * 3/2015 Skarlupka ..... H01H 13/06 200/16 B
9,053,848 B2 * 6/2015 Beyer ..... H01F 7/1615
9,159,512 B2 * 10/2015 Kodama ..... H01H 47/002
9,368,266 B2 * 6/2016 Maller ..... H01F 7/1607
9,412,545 B2 * 8/2016 Kubono ..... H01H 50/60
9,583,290 B2 * 2/2017 Horiguchi ..... H01H 50/22
9,799,471 B2 * 10/2017 Kralik ..... H01H 33/08
2013/0057369 A1 3/2013 Yano et al.
2013/0057377 A1 3/2013 Yano et al.
2013/0063231 A1 * 3/2013 Tomimbang ..... H01F 7/124 335/127
2013/0076464 A1 3/2013 Yano et al.
2013/0088311 A1 4/2013 Yano et al.
2013/0099880 A1 4/2013 Yano et al.
2013/0106542 A1 5/2013 Yano et al.
2013/0207750 A1 * 8/2013 Daitoku ..... H01H 50/00 335/126
2013/0207753 A1 8/2013 Yano et al.
2013/0214883 A1 8/2013 Yano et al.
2013/0222089 A1 * 8/2013 Daitoku ..... H01F 7/081 335/259
2013/0257568 A1 10/2013 Yano et al.
2014/0225691 A1 * 8/2014 Tanaka ..... H01F 7/1638 335/267

* cited by examiner

ELECTROMAGNETIC ACTUATOR AND ELECTRICAL CONTACTOR COMPRISING SUCH AN ACTUATOR

The present invention relates to an electromagnetic actuator for the operation of an electrical contactor, and to an electrical contactor comprising such an actuator.

In the field of electromagnetic actuators, the use of coils is known, for example from FR-A-2979745, for the generation of a magnetic field for the control of a spring-loaded moveable armature. The electromagnetic power required for the operation of the armature is high, specifically on the grounds of the large air gap between the armature and a spreading plate configured as an extension to a core inserted in each coil. One approach to the reduction of this power involves an increase in the active mating surface area of the spreading plate and the armature. This is associated with an increase in the mobile mass, i.e. in the mass of the armature, and with an over-dimensioning of the return spring, in order to ensure compliance with performance requirements for impact withstand. This over-dimensioning of the spring results in an increase in the electromagnetic power required. The result is consequently the opposite to that desired. Another potential approach involves the reduction of the spring constant of the return spring. This impairs the impact withstand performance of the actuator, which is not acceptable.

The invention is specifically intended to rectify these disadvantages by the disclosure of a new electromagnetic actuator, in which the operation of the moveable armature is improved, with no substantial increase in the dimensions of the actuator.

To this end, the invention relates to an electromagnetic actuator for the operation of an electrical contactor, wherein said actuator comprises a fixed part including at least one coil for generating a magnetic field, centered on a longitudinal axis, at least one core for concentrating the magnetic flux, this core being installed within the coil and provided with a spreading plate for the magnetic field which defines an active surface which is perpendicular to the longitudinal axis, and at least one magnetic flux return element. The actuator also comprises an armature which is moveable in translation along the longitudinal axis with respect to the fixed part, between a first position which is remote from the active surface and a second position which is close to this surface, in response to a load induced by the magnetic field, and at least one elastic return member for the restoration of the armature to a predetermined position, from among the first position and the second position. The spreading plate is provided with at least one rib for closing the magnetic field lines between the spreading plate and the armature, wherein this rib protrudes with respect to the active surface on the armature side, and is arranged at the level of one edge of the spreading plate.

As a result of the invention, the ribs reduce the average air gap between the spreading plate and the moveable armature, thus permitting the effective control of the position of the armature, together with an increase in the magnetic field generated by the coil at constant power. In practice, the geometry of the ribs permits a reduction in the mobile mass and, in consequence, an increase in the magnetic load at equivalent power, thereby permitting a reduction in the intensity of magnetic loading required for the operation of the armature. In the context of the application of the actuator in an electrical actuator with fixed and moving pads, the invention also permits an increase in the electromagnetic energy stored prior to the impact of these pads. As a result of the reduced air gap, the magnetic circuit is entirely enclosed between the spreading plate and the moveable armature, thereby inducing an increase in the electromagnetic force.

According to advantageous but mandatory aspects of the invention, an electromagnetic actuator of this type may incorporate one or more of the following characteristics, in any technically permissible combination:

- The dimensions of the armature, in a perpendicular plane to the axis of translation are compatible with the movement thereof in proximity to the active surface, longitudinally to the rib, to achieve the second position.
- The fixed part comprises two coils, with a core installed in each coil, wherein the spreading plate of each core is provided with at least one rib, arranged at the level of its opposing edge to the other spreading plate.
- The rib extends over the full length of the edge, on the level at which it is arranged.
- The rib is formed integrally to the spreading plate.
- The fixed part includes an air gap spacer, the dimensions of which are compatible with the positioning thereof on the active surface, adjacently to the rib.
- The ratio between the height of the rib, measured in parallel to the axis of translation of the armature, and the thickness of the armature, measured in parallel with this direction, ranges from 0.1 to 1.0, and preferably from 0.2 to 0.9.
- The ratio between the height of the rib, measured in parallel to the axis of translation of the armature, and the stroke of the armature, defined between its first and second positions, ranges from 0.1 to 1.5, and preferably from 0.2 to 0.9.
- The ratio between the width of the rib, measured in parallel to the active surface and perpendicularly to the edge along which the rib is arranged, and the stroke of the armature, defined between its first and second positions, ranges from 0.1 to 1.2, and preferably from 0.2 to 0.7.

The invention also relates to an electrical contactor comprising fixed pads and moveable pads which are driven by an armature which is associated with an actuator, characterized in that the actuator is of the type described above.

Understanding of the invention will be facilitated, and further advantages thereof clarified, by the following description of one mode of embodiment of an electrical actuator and an electrical contactor in accordance with the principle thereof, which is provided by way of an example only, with reference to the attached drawings, in which.

Figure 8:
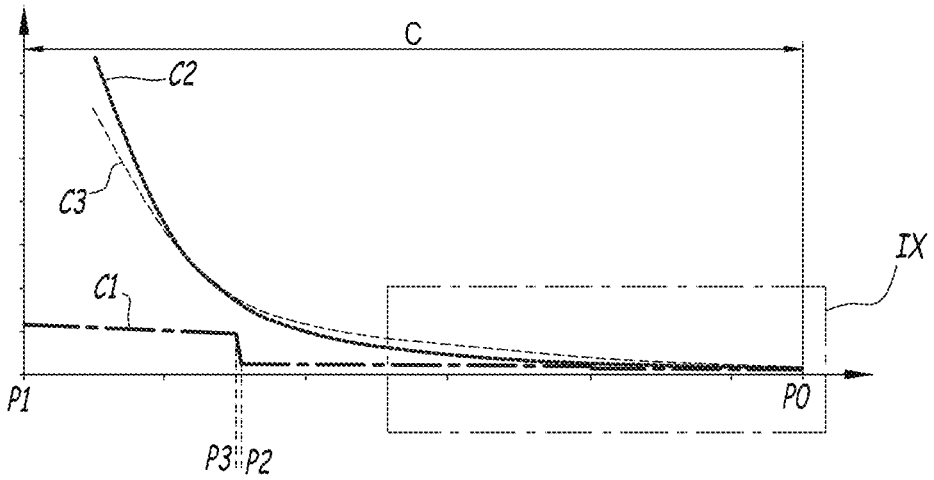
FIG. 8 shows a diagram representing the mechanical force exerted by the springs of the actuator represented in FIGS.
Figure 9:
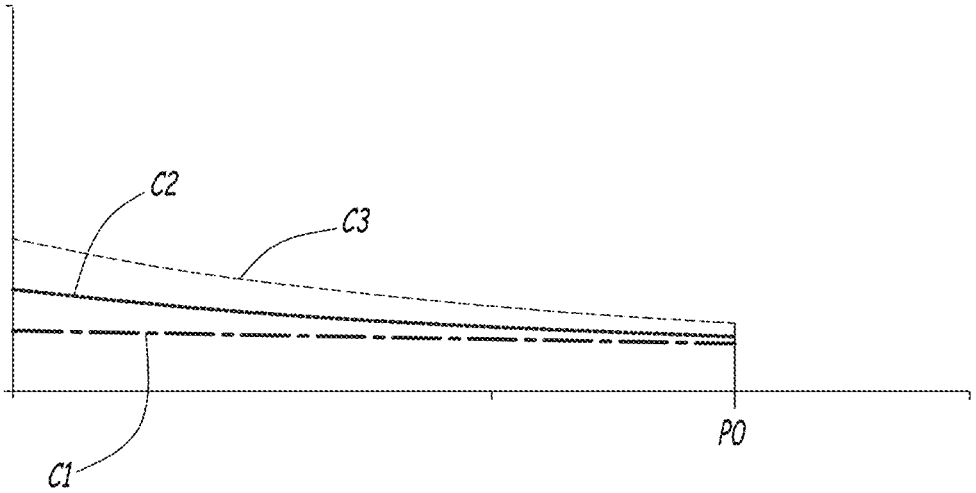

1 and 2, together with the magnetic forces present, firstly in this actuator, and secondly in another actuator according to the prior art, as a function of the position of the moveable armature in relation to the spreading plate;

FIG. 9 shows a view of the boxed area in FIG. 8, to a larger scale.

Figure 1:
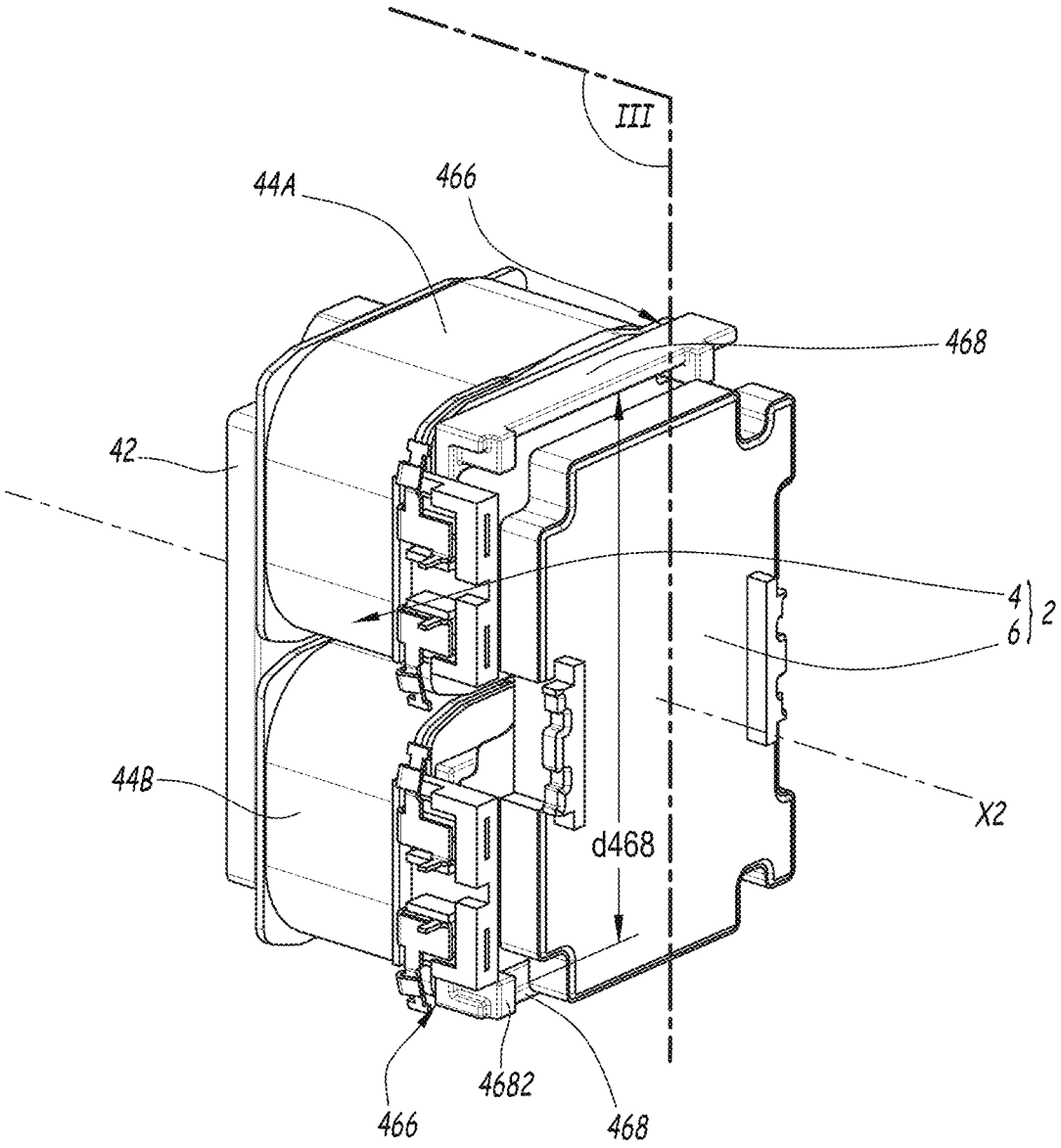
FIG. 1 shows a perspective view of an electromagnetic actuator according to the invention.
Figure 2:
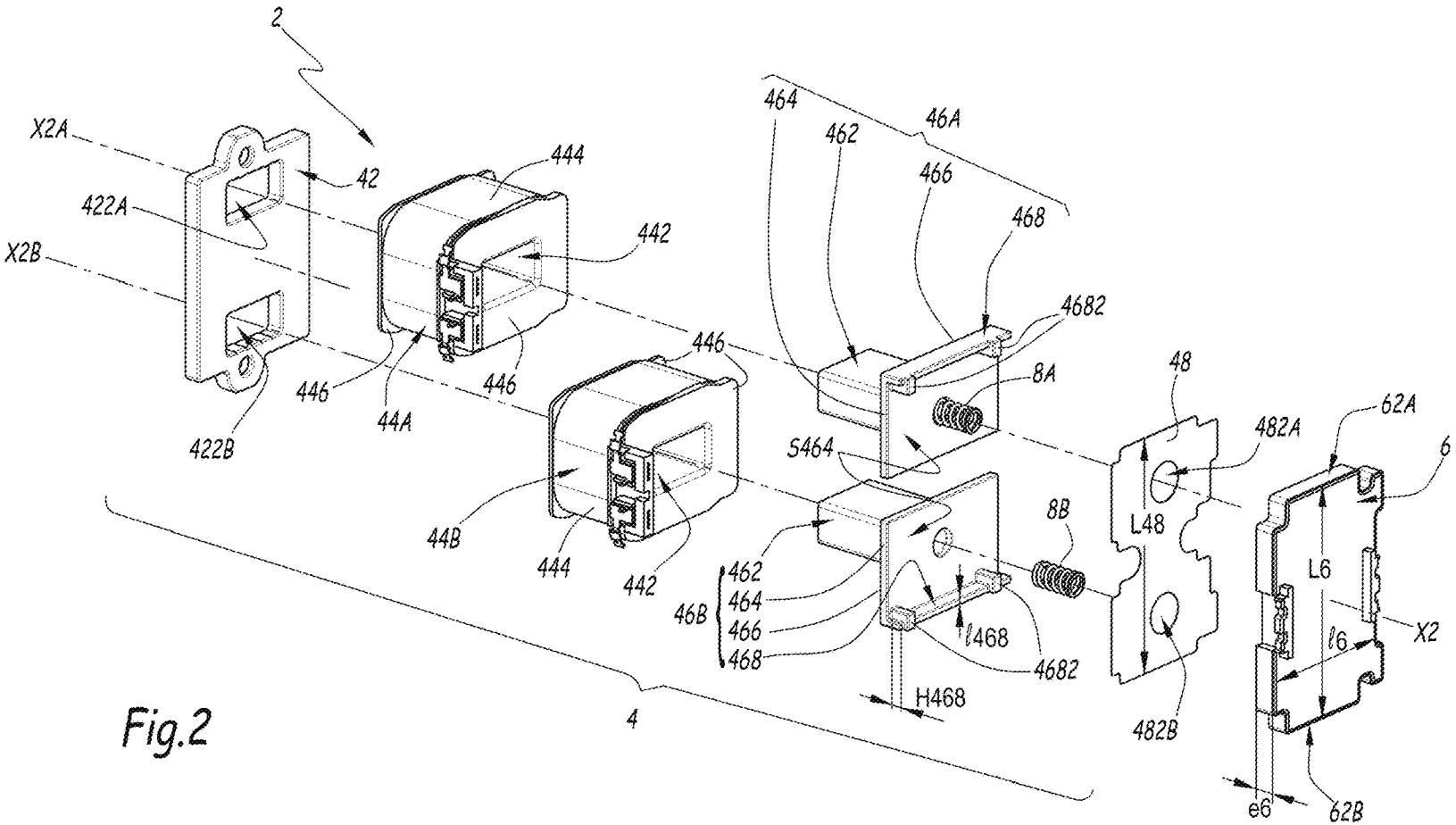
FIG. 2 shows an exploded perspective view of the actuator represented in FIG. 1.
Figure 5:
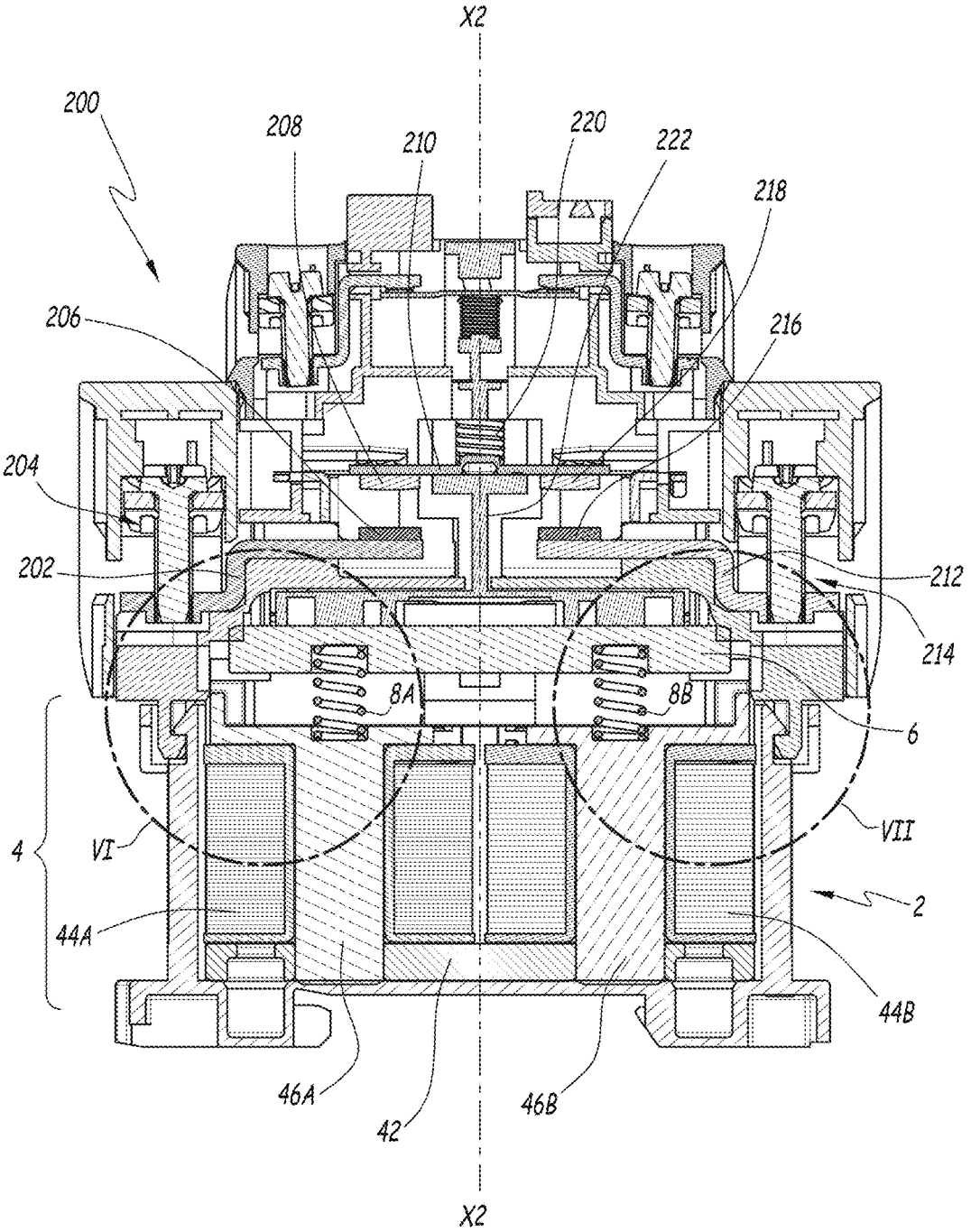
FIG. 5 shows a section of an electrical contactor incorporating the actuator represented in FIGS. 1 and 2. The plane section in FIG. 5 coincides with the plane III in FIG. 1.

FIGS. 1 and 2 show an electromagnetic actuator 2, which is designed for incorporation in an electrical contactor 200, represented in FIG. 5. The actuator 2 comprises a fixed part 4 and an armature 6 which is moveable in translation in relation to the fixed part 4, in a longitudinal axis X2 of the actuator 2.

The fixed part 4 comprises a base plate 42, two identical coils 44A and 44B, two identical cores 46A and 46B, and an air gap spacer 48. The base plate 42 incorporates two identical orifices 422A and 422B, each of which is centered on an axis X2A or X2B, parallel to the longitudinal axis X2. As the coils and the cores are identical, only the coil 44A and the core 46A are described in detail. The coil 44A defines a socket 442 around which a winding 444 is wound, arranged between two terminal plates 446. The socket 442 for the coil 44A is centered on the axis X2A, whereas the socket 442 for the coil 44B is centered on the axis X2B. The core 46A incorporates a leg 462 which is designed to pass through the socket 442 of the coil 44A and engage with the orifice 422A in the base plate 42. The leg 462 of each core 46A or 46B is extended by a spreading plate 464 which defines a surface S464 which is perpendicular to the longitudinal axis X2A.

The spreading plate 464 is rectangular. 466 represents an edge of the plate 464. With the two spreading plates 464 of the cores 46A and 46B in place in the coils 44A and 44B, and in the base plate 42, the edge 466 of the spreading plate 464 of the core 46A is arranged opposite the spreading plate 464 of the core 46B. Likewise, the edge 466 of the spreading plate 464 of the core 46B is arranged opposite the spreading plate 464 of the core 46A. In the presentation shown in FIG. 2, the edge 466 of the core 46A is the upper edge of its associated spreading plate 464, whereas the edge 466 of the core 46B is the lower edge.

A rib 468, which projects from the surface S464, is arranged along the edge 466 of the spreading plate 464, in the direction of the armature 6. The rib 468 is provided with two braces 4682, the function of which is the location of the cores 46A and 46B within the actuator 2.

A spring 8A is arranged between the surface S464 of the core 46A and the armature 6. Likewise, a spring 8B is arranged between the surface S464 of the core 46B and the armature 6. The air gap plate 48 is perforated by two orifices 482A and 482B for the passage of the springs 8A and 8B.

Figure 6:
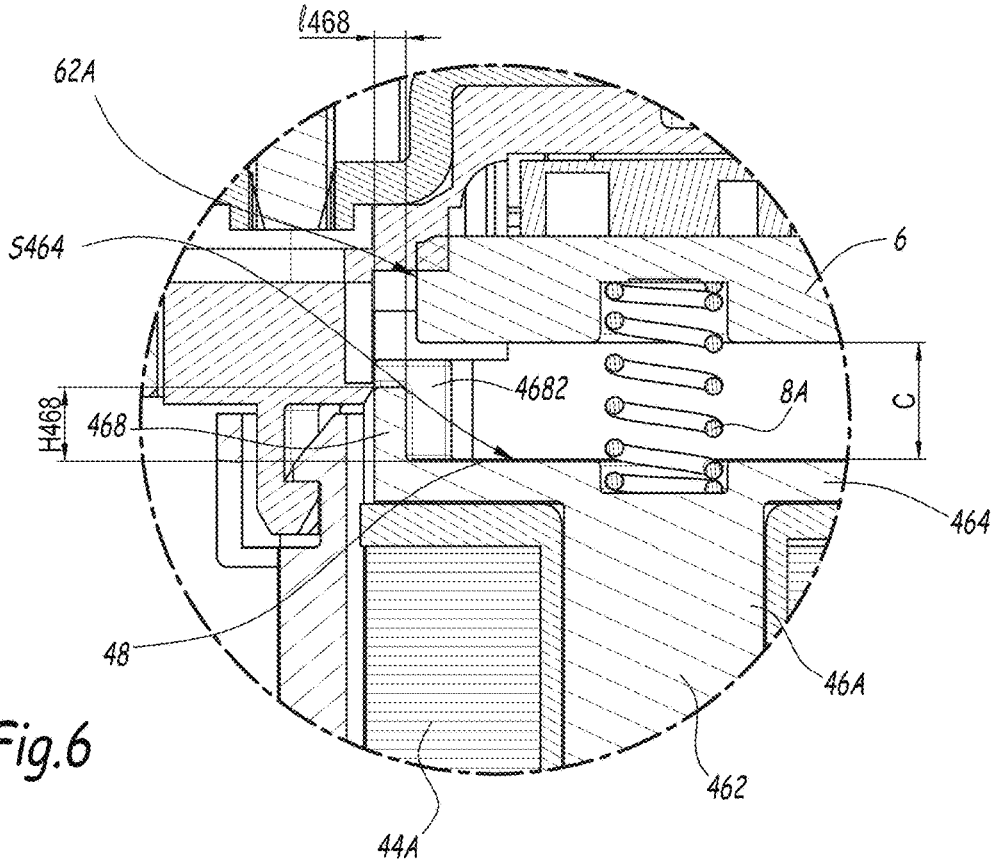
FIG. 6 shows a view of the circled area VI in FIG. 5, to a larger scale.
Figure 7:
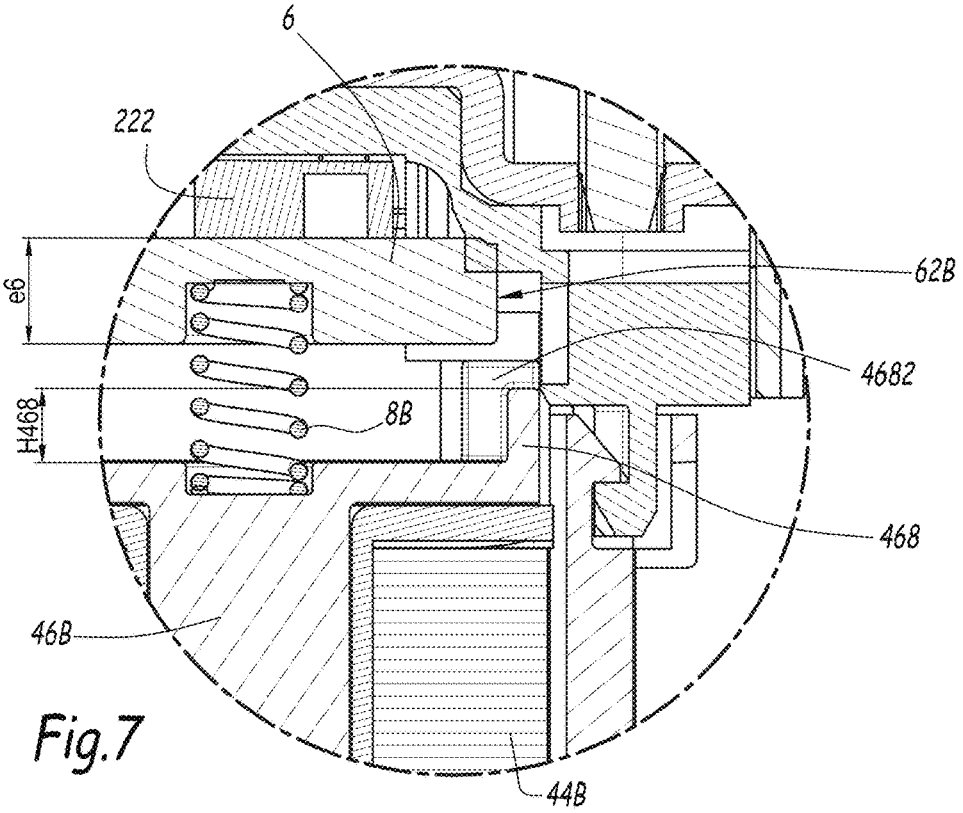
FIG. 7 shows a view of the circled area VII in FIG. 5, to a larger scale.

The moveable armature 6 moves in translation, parallel to the longitudinal axis X2, between a first position P0, which is remote from the air gap plate 48 and the spreading plates 464, wherein this position is represented in FIGS. 5 to 7, and a second position P1, which is close to the active surface S464, in a supporting arrangement between the air gap plate 48. In this second position, the moveable armature is positioned between the ribs 468. The letter C designates the stroke of the moveable armature 6 between these two positions P0 and P1. L6 represents the length of the armature 6, measured perpendicularly to the longitudinal axis X2 and parallel to a plane enclosing the axes X2A and X2B. I6 represents the width of the armature 6, measured perpendicularly to the axis X2 and to the length L6. The thickness of the armature 6 is represented by e6, which is measured in parallel to the axis X2. The distance between the ribs 468 of the cores 46A and 46B is represented by d468, measured perpendicularly to the longitudinal axis X2 and parallel to a plane enclosing the axis X2A and the axis X2B. The length L6 is shorter than the distance d468, thereby permitting the armature 6 to engage between the ribs 468 of the cores 46A and 46B, and to move in proximity to the surfaces S464. The armature 6 can therefore slide along each rib 468, in the axis X2.

L48 represents the length of tie air gap plate 48, measured in parallel to the length L6. The length L48 is shorter than the distance d468, thus permitting the fitting of the air gap plate 48 to the surfaces S464, between the ribs 468 of the cores 46A and 46B.

H468 represents the height of a rib 468, measured from the surface S464, parallel to the axis X2 and outside the braces 4682. The ratio between the height H468 and the thickness e6 ranges from 0.1 to 1.0, and preferably from 0.2 to 0.9. Moreover, the ratio between the height H468 and the stroke C of the armature 6 ranges from 0.1 to 1.5, and preferably from 0.2 to 0.9.

I468 represents the width of the rib 468, measured in parallel to the active surface S464 and perpendicularly to the adjacent edge 466, outside the braces 4682. The ratio between the width I468 and the stroke C of the armature 6 ranges from 0.1 to 1.2, and preferably from 0.2 to 0.7. In practice, the width of the rib is a compromise between its level of induction, the increase in load, and the increase in the mass of the armature.

For example, where the stroke C is equal to 5.5 mm, the height H468 ranges from 1 to 5 mm, and the width I468 ranges from 1 to 4 mm.

The cores 46A and 46B are of one-piece construction, formed, for example, by metal sintering. As a variant, the spreading plate 464 and the rib 468 are of one-piece construction, and are fitted to the leg 462, for example by welding. According to a further variant, the leg 462, the spreading plate 464 and the rib 468 of the cores 46A and 46B are formed separately and are then combined in an assembly, for example by welding.

62A and 62B represent the edges of the moveable armature 6, parallel to the width thereof I6.

Figure 3:
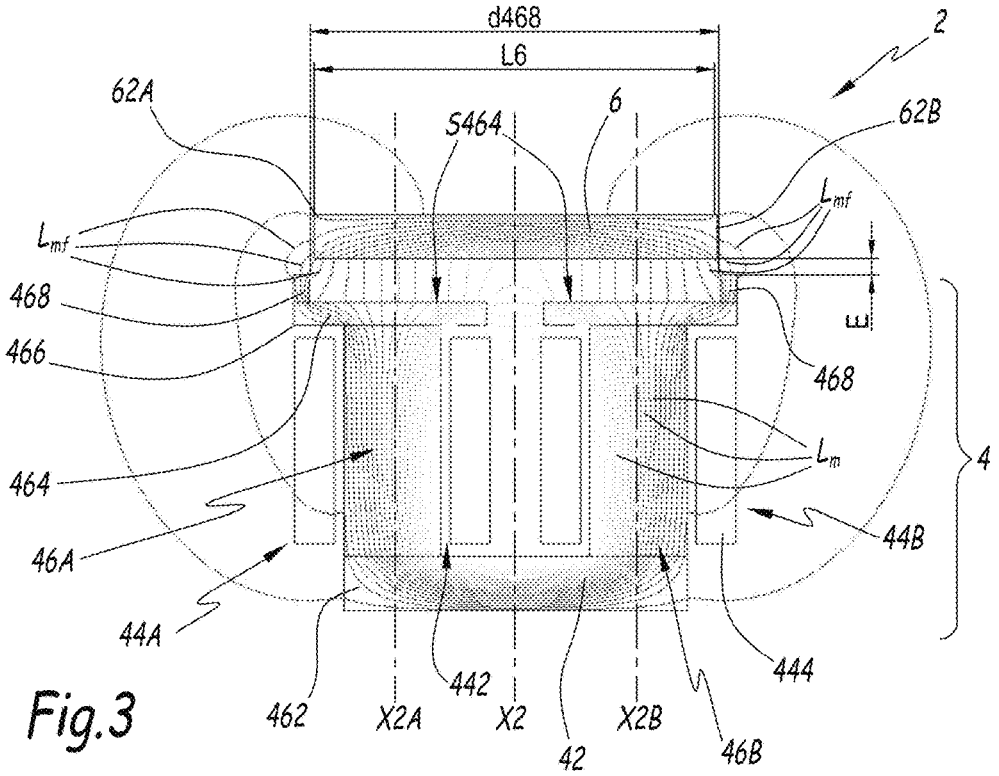
FIG. 3 shows a diagram representing the distribution of magnetic field lines between the moveable armature and the fixed part of the actuator represented in FIGS. 1 and 2, in the plane section III indicated in FIG. 1.
Figure 4:
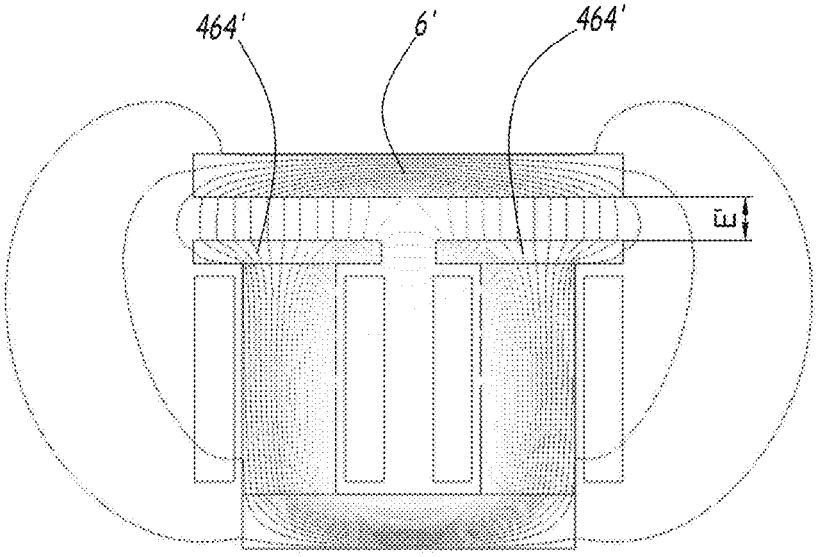
FIG. 4 is analogous to FIG. 3, but for an actuator according to the prior art.

In FIG. 3, in the interests of the clarity of the drawing, the air gap plate 48 and the springs 8A and 8B are not represented. FIG. 3 shows the magnetic field lines $L_m$, which run between the moveable armature 6 and the cores 46A and 46B, as a result of the magnetic field generated by the coils 44A and 44B. It will be observed on this figure that the closed loops of the magnetic field lines $L_m$ pass through the base plate 42, which thus constitutes a magnetic flux return element. $L_{mf}$ represents the connecting magnetic field lines which run, on one side, between the edge 62A and the rib 468 of the core 46A, and on the other side between the edge 62B and the rib 468 of the core 46B. The connecting magnetic field lines $L_{mf}$ pass through an air gap E, which is significantly less deep than the air gap E' which exists between the moveable armature 6' and the spreading plates 464' of an actuator according to the prior art, as represented in FIG. 4. Thus during certain phases of operation of the contactor 200, the ribs 468 allow the intensity of the electromagnetic field between the armature 6 and the cores 46A and 46B to be increased, in relation to the prior art. The magnetic field resulting from the small air gap permits the effective control of the longitudinal position of the moveable armature 6 on the axis X2.

These improvements are achieved whilst maintaining the overall footprint of the actuator 2, as can be seen from a comparison of FIGS. 3 and 4.

In FIGS. 5, 6 and 7, the actuator 2 is integrated in an electrical contactor 200. The electrical contactor 200 comprises a first fixed track 202, which extends from a zone 204 for the blocking of an electrical conductor and carries a fixed contact pad 206.

The contactor 200 also comprises a second fixed track 212, which extends between a zone 214 for the connection of an electrical conductor and a fixed contact pad 216. The electrical contactor 200 also comprises two moveable contact pads 208 and 218, mounted on a moveable bridge 210. This moveable bridge 210 is loaded by a spring 220, in parallel to the axis X2 and in the direction of the moveable armature 6. A moveable contact holder 222 is interposed between the moveable bridge 210 and the moveable armature 6. Each of the tracks 202 and 212 forms a current path.

In FIG. 8, position P0 represents the first position, which is remote from the moveable armature 6 in relation to the surface S464. Position P1 represents the second and closer position, in which the moveable armature 6 is in contact with the air gap plate 48. In this figure, position P2 represents an intermediate position, in which the moveable pads 208 and 218 engage with the fixed pads 206 and 216, en route from position P0 to position P1. In FIG. 8, the distance between positions P0 and P1 represents the stroke C.

Starting position P0, where the moveable armature 6 is moved by the magnetic force generated by the magnetic field associated with the coils 44A and 44B, the resistant mechanical force generated by the springs 8A and 8B increases in a linear manner, as shown in the right-hand section of the curve C1. From position P2, the continuing movement of the moveable armature 6 results in the separation of the moveable contact holder 222 and the moveable bridge 210, together with the compression of the spring 220, the spring constant of which is combined with that of the springs 8A and 8B. The curve C1 thus assumes a steeper ramp from position P2 onwards than between positions P0 and P2. The full establishment of electrical contact is represented by a position P3, with effect from which the springs 8A and 8B and the spring 220 continue to be compressed, until position P1 is reached.

In FIGS. 8 and 9, the curve C2 represents the magnetic force exerted by an actuator according to the prior art, and the curve C3 represents the magnetic force exerted by an actuator according to the invention. As a result of the ribs 468, the curve C3 lies above the curve C2 between positions P0 and P3. In other words, the magnetic force is stronger with the ribs 468 than in the absence of said ribs. Conversely, as it approaches position P1, the curve C3 moves below the curve C2. In other words, after the engagement of the pads 208 and 218 with the pads 206 and 216, the magnetic force employed in the actuator 2 according to the invention is lower than the magnetic force employed in an actuator according to the prior art. In summary, the addition of these ribs 468 permits the generation of an additional magnetic force where necessary, between positions P0 and P3, and the reduction thereof where this force is not necessary, between positions P3 and P1.

It will be observed that the ribs 468 extend over the full length of the edges 466, thus permitting their participation in the closure of the field lines over the full width I6 of the moveable armature 6. However, as a variant, a rib 468 may be interrupted in its length, or may extend over only part of the adjacent edge 466.

The invention is described heretofore with respect to a two-coil and two-ribbed actuator. It is applicable to a single-coil actuator, in which case the geometry of the magnetic flux return element, which corresponds to the base plate 42 in the example shown in the figures, is adjusted accordingly.

According to one mode of embodiment, which is not represented, ribs which are analogous to the rib 468 may be provided on three adjacent edges of a spreading plate 464, excluding the closest edge of the other spreading plate. In other words, according to this unrepresented variant, the invention can have a maximum of six ribs. The modes of embodiment and variants described heretofore can be combined to create new modes of embodiment of the invention.

The invention claimed is:

1. An electromagnetic actuator for operation of an electrical contactor, the actuator comprising:

a fixed part including:

at least one coil that generates a magnetic field and that is centered on a longitudinal axis, at least one core that concentrates the magnetic flux, the core being installed within the coil, and including a spreading plate for the magnetic field which defines an active surface which is perpendicular to the longitudinal axis and at least one magnetic flux return element;

an armature that is moveable in translation along the longitudinal axis with respect to the fixed part, between a first position which is remote from the active surface and a second position which is closer to the surface, in response to a load induced by the magnetic field;

at least one elastic return member that restores the armature to a predetermined position, from among the first position and the second position;

wherein the spreading plate includes at least one rib closing magnetic field lines between the spreading plate and the armature, the rib protrudes with respect to the active surface on the armature side, the rib is arranged at a level of one edge of the spreading plate, and the rib includes braces extending in a direction perpendicular to a longest dimension of the rib.

2. The actuator as claimed in claim 1, wherein dimensions of the armature, in a perpendicular plane to the axis of translation, are compatible with movement thereof in proximity to the active surface, longitudinally to the rib, to achieve the second position.

3. The actuator as claimed in claim 1, wherein the fixed part comprises two coils, with a core installed in each coil, wherein the spreading plate of each core includes at least one rib, arranged at a level of its opposing edge to the other spreading plate.

4. The actuator as claimed in claim 1, wherein the rib extends over a full length of the opposing edge, on a level at which it is arranged.

5. The actuator as claimed in claim 1, wherein the rib is formed integrally to the spreading plate.

6. The actuator as claimed in claim 1, wherein the fixed part includes an air gap spacer, dimensions of which are compatible with positioning thereof on the active surface, adjacently to the rib.

7. The actuator as claimed in claim 1, wherein the ratio between the height of the rib, measured in parallel to the axis of translation of the armature, and the thickness of the armature, measured in parallel with this direction, ranges from 0.1 to 1.0.

8. The actuator as claimed in claim 1, wherein the ratio between the height of the rib, measured in parallel to the axis of translation of the armature, and the thickness of the armature, measured in parallel with this direction, ranges from 0.2 to 0.9.

9. The actuator as claimed in claim 1, wherein the ratio between the height of the rib measured in parallel to the axis of translation of the armature, and the stroke of the armature, defined between its first and second positions, ranges from 0.1 to 1.5.

10. The actuator as claimed in claim 1, wherein the ratio between the height of the rib measured in parallel to the axis of translation of the armature, and the stroke of the armature, defined between its first and second positions, ranges from 0.2 to 0.9.

11. The actuator as claimed in claim 1, wherein the ratio between the width of the rib, measured in parallel to the active surface and perpendicularly to the edge along which the rib is arranged, and the stroke of the armature, defined between its first and second positions, ranges from 0.1 to 1.2.

12. The actuator as claimed in claim 1, wherein the ratio between the width of the rib, measured in parallel to the active surface and perpendicularly to the edge along which the rib is arranged, and the stroke of the armature, defined between its first and second positions, ranges from 0.2 to 0.7.

13. An electrical contactor comprising fixed pads and moveable pads which are driven by an armature which is associated with an actuator as claimed in claim 1.

* * * * *